US011172307B2

(12) United States Patent
Kubota et al.

(10) Patent No.: US 11,172,307 B2
(45) Date of Patent: Nov. 9, 2021

(54) SPEAKER

(71) Applicant: JVCKENWOOD Corporation, Yokohama (JP)

(72) Inventors: Takahiro Kubota, Yokohama (JP); Yasunari Takabatake, Yokohama (JP); Yuji Negishi, Yokohama (JP); Kazuyuki Inagaki, Yokohama (JP)

(73) Assignee: JVCKENWOOD CORPORATION, Yokohama (JP)

( * ) Notice: Subject to any disclaimer, the term of this patent is extended or adjusted under 35 U.S.C. 154(b) by 0 days.

(21) Appl. No.: 17/001,297

(22) Filed: Aug. 24, 2020

(65) Prior Publication Data

US 2021/0067876 A1 Mar. 4, 2021

(51) Int. Cl.
*H04R 7/12* (2006.01)
*H04R 7/18* (2006.01)

(52) U.S. Cl.
CPC ..... *H04R 7/12* (2013.01); *H04R 7/18* (2013.01); *H04R 2307/207* (2013.01)

(58) Field of Classification Search
CPC ..... H04R 7/12; H04R 7/18; H04R 2307/207
See application file for complete search history.

(56) References Cited

U.S. PATENT DOCUMENTS 7,835,538 B2 * 11/2010 Inoue ..... H04R 9/045 381/423

FOREIGN PATENT DOCUMENTS

JP 2016-021693 A 2/2016

* cited by examiner

*Primary Examiner* — Andrew L Sniezek
(74) *Attorney, Agent, or Firm* — Nath, Goldberg & Meyer; Jerald L. Meyer

(57) ABSTRACT

One or more holes are formed in a first diaphragm. A second diaphragm is arranged on a sound emitting side of the first diaphragm. A driver includes a magnetic circuit and a voice coil, and vibrates the first and second diaphragms. The second diaphragm includes a rigidity-reinforcing portion in which a rigidity of the second diaphragm is reinforced at a position facing at least one hole of the one or more holes.

10 Claims, 9 Drawing Sheets

SPEAKER

CROSS REFERENCE TO RELATED APPLICATION

This application is based upon and claims the benefit of priority under 35 U.S.C. § 119 from Japanese Patent Application No. 2019-156683 filed on Aug. 29, 2019, the entire contents of which are incorporated herein by reference.

BACKGROUND

The present disclosure relates to a speaker such as a subwoofer.

A subwoofer which is an example of a speaker has a large vibration amount (stroke) of a diaphragm (see Japanese Unexamined Patent Application Publication No. 2016-21693). In order to move the diaphragm smoothly, holes may be provided in the diaphragm to allow air to escape.

SUMMARY

An opening for passing a voice coil bobbin is formed in the center of the diaphragm (a first diaphragm). A cap (a second diaphragm) is attached to the surface of the diaphragm so as to cover the opening. In a speaker having the diaphragm provided with holes for allowing air to escape, when the diaphragm vibrates, the air hitting the cap through the holes may causes distortion of the cap, resulting in poor sound quality.

An aspect of one or more embodiments provides a speaker including: a first diaphragm including one or more holes formed therein; a second diaphragm arranged on a sound emitting side of the first diaphragm; and a driver including a magnetic circuit and a voice coil, and is configured to vibrate the first and second diaphragms, wherein the second diaphragm includes a rigidity-reinforcing portion in which a rigidity of the second diaphragm is reinforced at a position facing at least one hole of the one or more holes.

DETAILED DESCRIPTION

Figure 1:
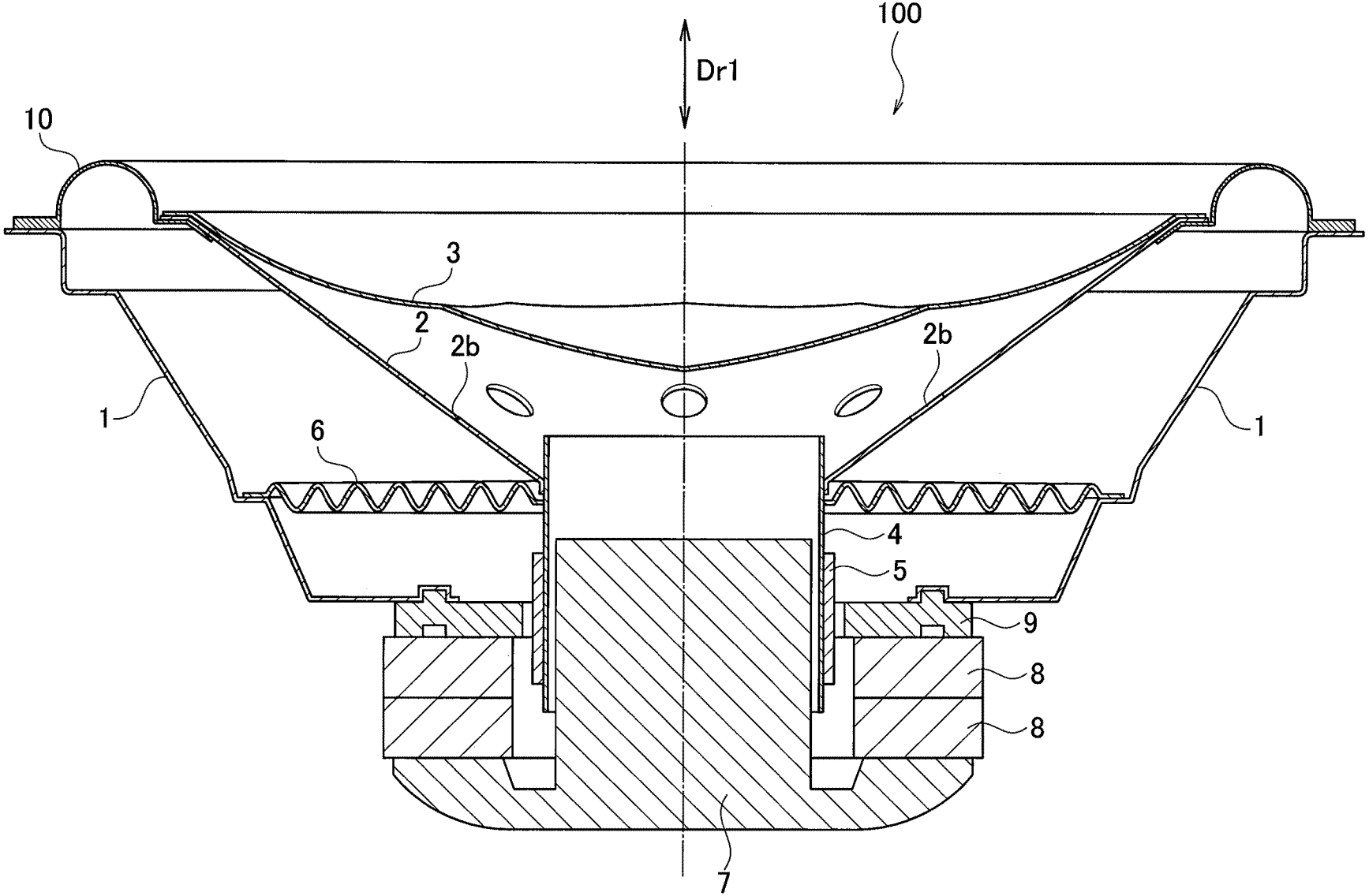
FIG. 1 is a cross-sectional view illustrating a speaker according to one or more embodiments.

Hereinafter, a speaker according to one or more embodiments will be described with reference to the accompanying drawings. In FIG. 1, a speaker 100 according to one or more embodiments includes a frame 1, a diaphragm 2, a cap 3, a voice coil bobbin 4, a voice coil 5, a damper 6, a yoke 7, a permanent magnet 8, a top plate 9, and an edge 10. The frame 1 is composed of a metal plate. The diaphragm 2 is formed in a cone shape with an arbitrary material such as a synthetic resin or the like. The outer peripheral end portion of the diaphragm 2 is fixed to the edge 10, and the inner circumference portion thereof is fixed to the cylindrical voice coil bobbin 4. The voice coil 5 is wound around the outer peripheral surface of the voice coil bobbin 4. The diaphragm 2 is formed with a plurality of holes 2*b*.

The edge 10 is an annular elastically deformable member, and is fixed to the outer peripheral end portion of the frame 1. The cap 3 is arranged on the side of the diaphragm 2 that emits sound (sound emitting direction), and covers the entire diaphragm 2. The outer peripheral end portion of the cap 3 is fixed to the outer peripheral end portion of the diaphragm 2 fixed to the edge 10. That is, the outer peripheral end portion of the cap 3 is indirectly fixed to the edge 10. The cap 3 is formed with an arbitrary material such as synthetic resin or the like. The diaphragm 2 and the cap 3 are separated from each other in the vibration direction of the diaphragm (the sound emitting direction or the opposite direction thereof) except for the portion fixed to the edge 10. The cap 3 protects the diaphragm 2 and prevents dust or the like from entering the inside of the voice coil bobbin 4.

The cap 3 is not limited to the structure in which the outer peripheral end portion thereof is fixed to the outer peripheral end portion of the diaphragm 2, and the outer peripheral end portion of the cap 3 may be fixed to any position in the radial direction of the diaphragm 2. In other words, the cap 3 may have a shape that does not cover the entire diaphragm 2 but covers a part thereof.

The damper 6 is formed with a bellows-like elastically deformable member, and connects the frame 1 with the voice coil bobbin 4. The yoke 7, the permanent magnet 8, and the top plate 9 form a magnetic circuit that vibrates the diaphragm 2 and the cap 3. The permanent magnet 8 and the top plate 9 are annular and are inserted into the yoke 7. The top plate 9 is fixed to the frame 1. The voice coil 5 is arranged in the gap between the yoke 7 and the top plate 9.

When a current according to an audio signal is supplied to the voice coil 5 from the outside, a force according to Fleming's left-hand rule is generated in the voice coil 5, because a current flows in the static magnetic field formed by the magnetic circuit. Due to this force, the diaphragm 2 and the cap 3 vibrate together with the voice coil bobbin 4 and the voice coil 5 in the double-headed arrow Dr1 direction shown in FIG. 1. In other words, the magnetic circuit and the voice coil 5 constitute a driver. The cap 3 also substantially functions as a diaphragm. When the diaphragm 2 is assumed to be the first diaphragm, the cap 3 is the second diaphragm.

Figure 2:
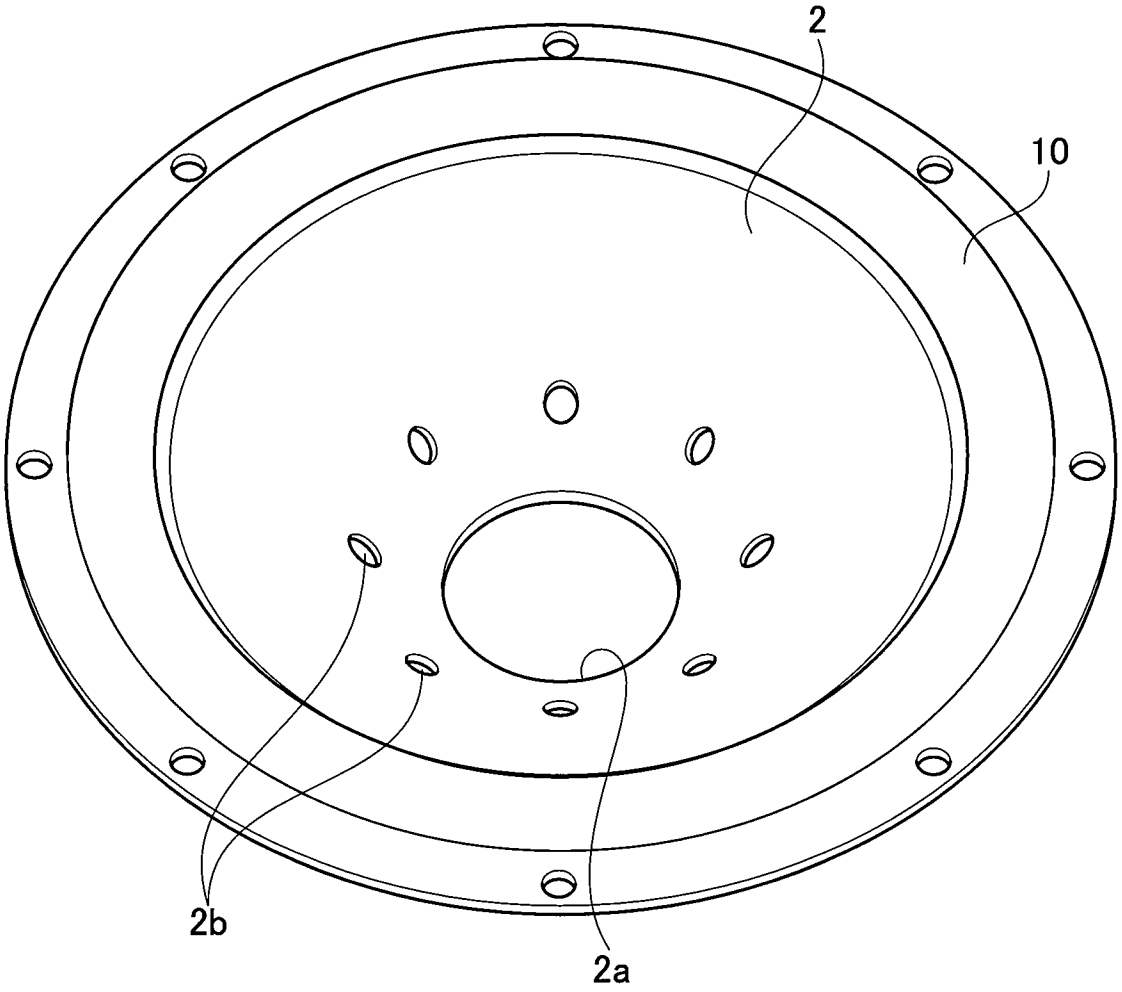
FIG. 2 is a perspective view illustrating a diaphragm having the outer peripheral end portion fixed with an edge.

FIG. 2 illustrates the diaphragm 2 in which the edge 10 is fixed to the outer peripheral end portion thereof. The diaphragm 2 includes a circular opening 2*a* located at the center and a plurality of holes 2*b*. The voice coil bobbin 4 is fixed to the opening 2*a*. As an example, the diaphragm 2 includes eight holes 2*b* formed at predetermined radial positions at equal intervals in the circumferential direction. The eight holes 2*b* are located on the same circumference.

When the diaphragm 2 is displaced by the vibration of the diaphragm 2 in the sound emitting direction, that is, in the direction away from the yoke 7, the space formed by the diaphragm 2, the cap 3, and the voice coil bobbin 4 expands. Then, the air on the back side of the diaphragm 2 passes through the holes 2*b* and then flows into the space formed by the diaphragm 2, the cap 3, and the voice coil bobbin 4, which is the front side where the cap 3 is disposed. When the diaphragm 2 is displaced in the direction opposite to the sound emitting direction, that is, when it is displaced toward the yoke 7, the above space shrinks, and the air on the front side of the diaphragm 2 existing in the space flows to the back side.

The holes 2*b* formed in the diaphragm 2 serve as ventilation holes, and the air resistance applied to the diaphragm 2 is reduced. Therefore, the diaphragm 2 vibrates smoothly. The speaker 100 can smoothly move the diaphragm 2 with a large stroke.

Figure 3:
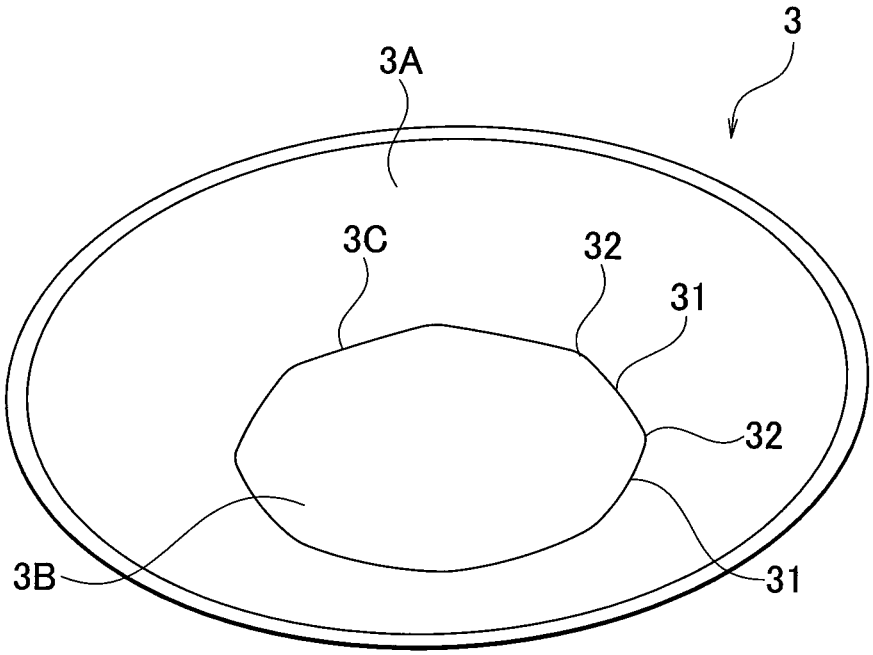
FIG. 3 is a perspective view illustrating a cap viewed from the front side.
Figure 4:
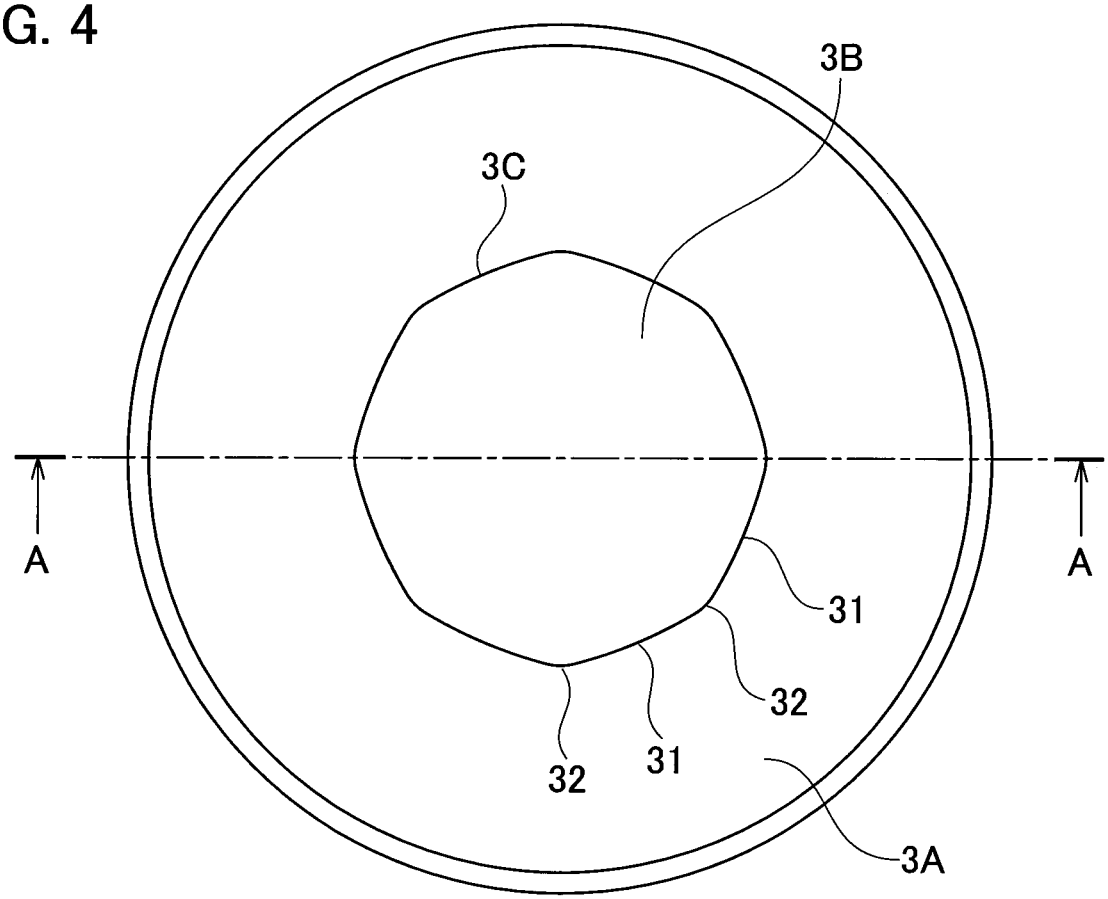
FIG. 4 is a plan view illustrating the cap viewed from the front side.
Figure 5:
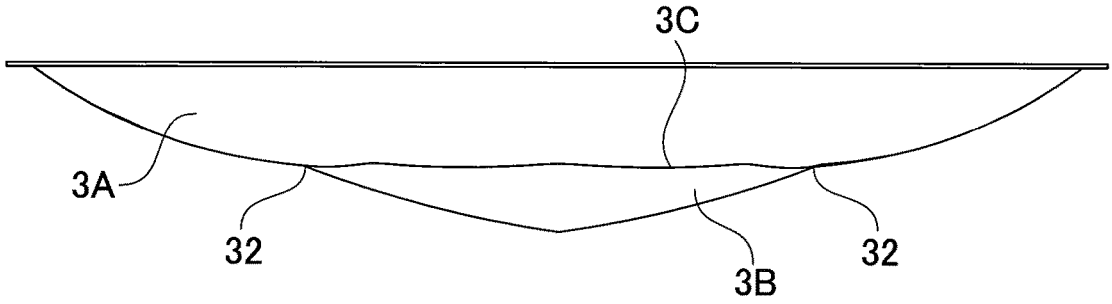
FIG. 5 is a side view illustrating the cap.
Figure 6:
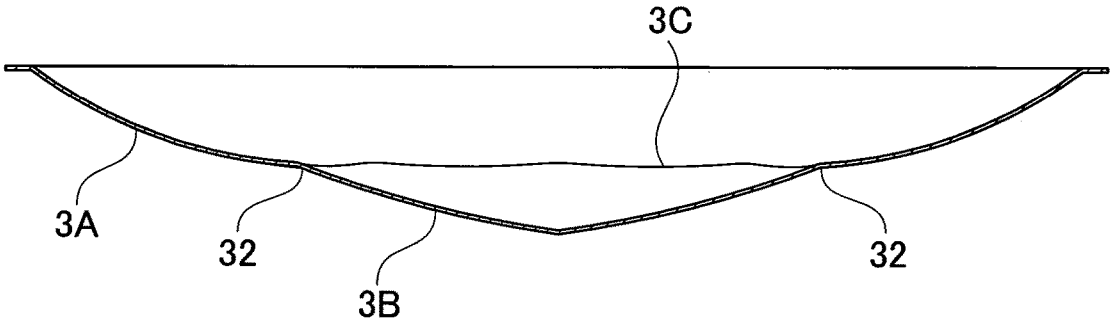
FIG. 6 is an A-A cross-sectional view of FIG. 4.

FIG. 3 is a perspective view of the cap 3 viewed from the front side, FIG. 4 is a plan view of the cap 3 viewed from the front side, FIG. 5 is a side view of the cap 3, and FIG. 6 is a cross-sectional view which is taken along a line A-A of FIG. 4. As shown in FIGS. 3 to 6, the cap 3 includes an outer portion 3A and an inner portion 3B. As shown in FIGS. 3 and 4, an octagonal boundary portion 3C is formed between the outer portion 3A and the inner portion 3B. The boundary portion 3C is a rigidity-reinforcing portion having eight sides 31 and eight corners 32.

The boundary portion 3C does not need to be a regular octagon, but is preferably a regular octagon in accordance with the eight holes 2*b* formed in the diaphragm 2 at equal intervals in the circumferential direction. When the boundary portion 3C has a regular octagonal shape, the air flow becomes constant in the circumferential direction, and the diaphragm 2 and the cap 3 can vibrate in a well-balanced manner. The boundary portion 3C is preferably formed at a position where the air flowing through the holes 2*b* formed in the diaphragm 2 hits the cap 3 that is a position facing the holes 2*b*.

Since eight holes 2*b* are formed in the diaphragm 2, the boundary 3C is preferably octagonal. If six holes 2*b* arranged at equal intervals on the same circumference are formed in the diaphragm 2, the boundary portion 3C is preferably hexagonal. If ten holes 2*b* arranged at equal intervals on the same circumference are formed in the diaphragm 2, the boundary portion 3C is preferably decagonal. It is preferable to set the number n of holes 2*b* to three or more so that the boundary portion 3C has an n-sided shape. The number n of the holes 2*b* may be one or two.

As shown in FIGS. 5 and 6, the boundary portion 3C that presents between the outer portion 3A and the inner portion 3B has a bent shape. The cap 3 is formed by integral molding with a synthetic resin, and the bent shape of the boundary portion 3C means a shape as if the cap is folded. The boundary portion 3C is a recess existing on the back surface of the cap 3 facing the diaphragm 2 on the way from the center portion to the outer peripheral end portion of the cap 3 in the radial direction. In other words, the boundary portion 3C is a protrusion that protrudes toward the front side of the cap 3.

Figure 7:
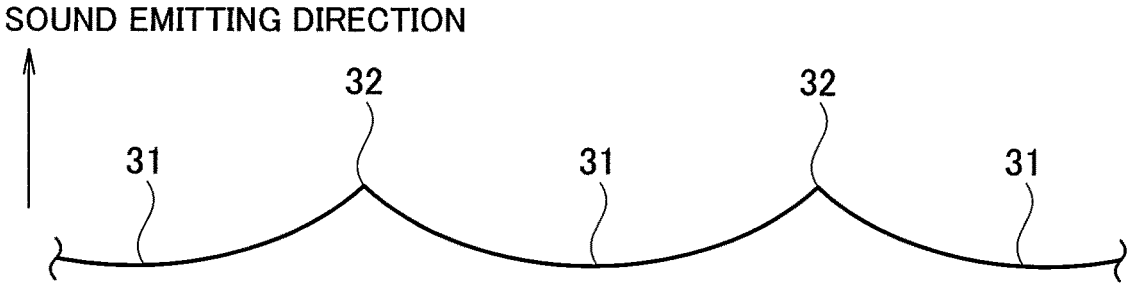
FIG. 7 is a diagram conceptually illustrating the positional relationship in the height direction between the sides and the corners at the boundary portion of the cap.

FIG. 7 conceptually illustrates the positional relationship between the sides 31 and the corners 32 in the height direction at the boundary portion 3C of the cap 3. The upper direction of FIG. 7 is the sound emitting direction. As illustrated in FIG. 7, the octagonal boundary portion 3C becomes higher in order as it approaches the corner 32 from the central portion of the side 31, and the corner 32 is at the highest position. That is, the corners 32 are recesses existing in the circumferential direction of the boundary portion 3C on the back surface of the cap 3, and are protrusions that protrude toward the front side of the cap 3.

As can be seen from the above, each corner 32 of the octagonal boundary portion 3C has a recessed shape on the back surface of the cap 3 in both of the radial direction and the circumferential direction of the cap 3. The corner 32 preferably has a recessed shape in both of the radial direction and the circumferential direction of the cap 3, but may have a recessed shape only in the radial direction.

Since the boundary portion 3C has a bent shape, the rigidity is reinforced as compared with the outer portion 3A and the inner portion 3B other than the boundary portion 3C. That is, the boundary portion 3C (the sides 31 and the corners 32) is a rigidity-reinforcing portion in which the rigidity of the cap 3 is reinforced. Since the rigidity-reinforcing portion composed of the boundary portion 3C is continuously formed over the entire circumference in the circumferential direction, the rigidity is further reinforced as compared with the shape in which the rigidity-reinforcing portions are discretely formed in the circumferential direction.

Here, the state of air flow will be described by focusing on a single hole 2*b* and the rigidity-reinforcing portion facing the hole 2*b*. As described above, the boundary portion 3C, which is the rigidity-reinforcing portion, is formed at a position where the air flowing through the hole 2*b* formed in the diaphragm 2 hits the cap 3. With this structure, it is possible to suppress unnecessary vibration of the cap 3 caused by blowing of air, and prevent deterioration of sound quality. The blown air flows in the radial direction of the cap 3, and also flows in the circumferential direction along the groove of the boundary portion 3C on the back side of the cap 3. That is, the boundary portion 3C can rectify the air flowing through the hole 2*b* in the radial direction and the circumferential direction.

In addition, since the corners 32 are arranged at equal angular intervals on the boundary portion 3C, an unbiased and balanced air flow centered on each corner is generated in the entire interior of the space created by the diaphragm 2 and the cap 3. Accordingly, it is possible to reduce the air resistance due to the turbulence of the air flow when the diaphragm 2 vibrates.

The rigidity-reinforcing portion provided on the cap 3 is not limited to a recessed shape on the back surface of the cap 3, but may be a protruded shape. The protruded shape may be a bent shape, or may be formed with a rib. The thickness of the cap 3 may be changed so that the surface of the cap 3 has a protruded shape or the back surface has a protruded shape.

When the diaphragm 2 has only one hole 2*b*, the holes 2*b* cannot be arranged at equal intervals on the circumference. Therefore, the air flow between the diaphragm 2 and the cap 3 tends to be disturbed in the circumferential direction. Further, when the number of the holes 2*b* is small such as one or two, the amount of air ventilated in each of the holes 2*b* is large and the flow velocity is high, as compared with the case where many holes 2*b* are formed. For these reasons, when the number of holes 2*b* is small, the rigidity of the boundary portion 3C may be further reinforced. Specifically, it is preferable to increase the height of the corners 32 facing the holes 2*b* in the boundary portion 3C, or to form the boundary portion 3C with a thick rib.

Figure 8:
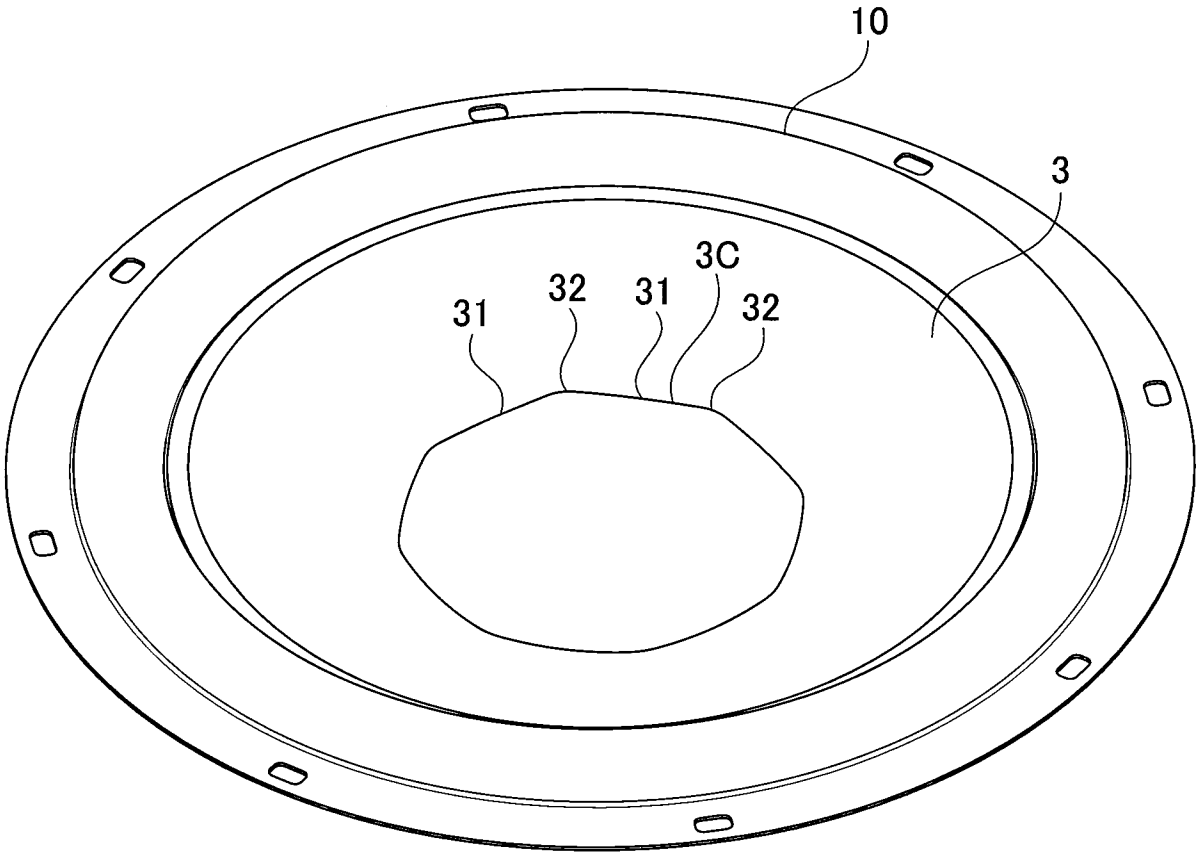
FIG. 8 is a perspective view illustrating a state in which the cap is fixed to the diaphragm to which the edge is fixed viewed from the front side.
Figure 9:
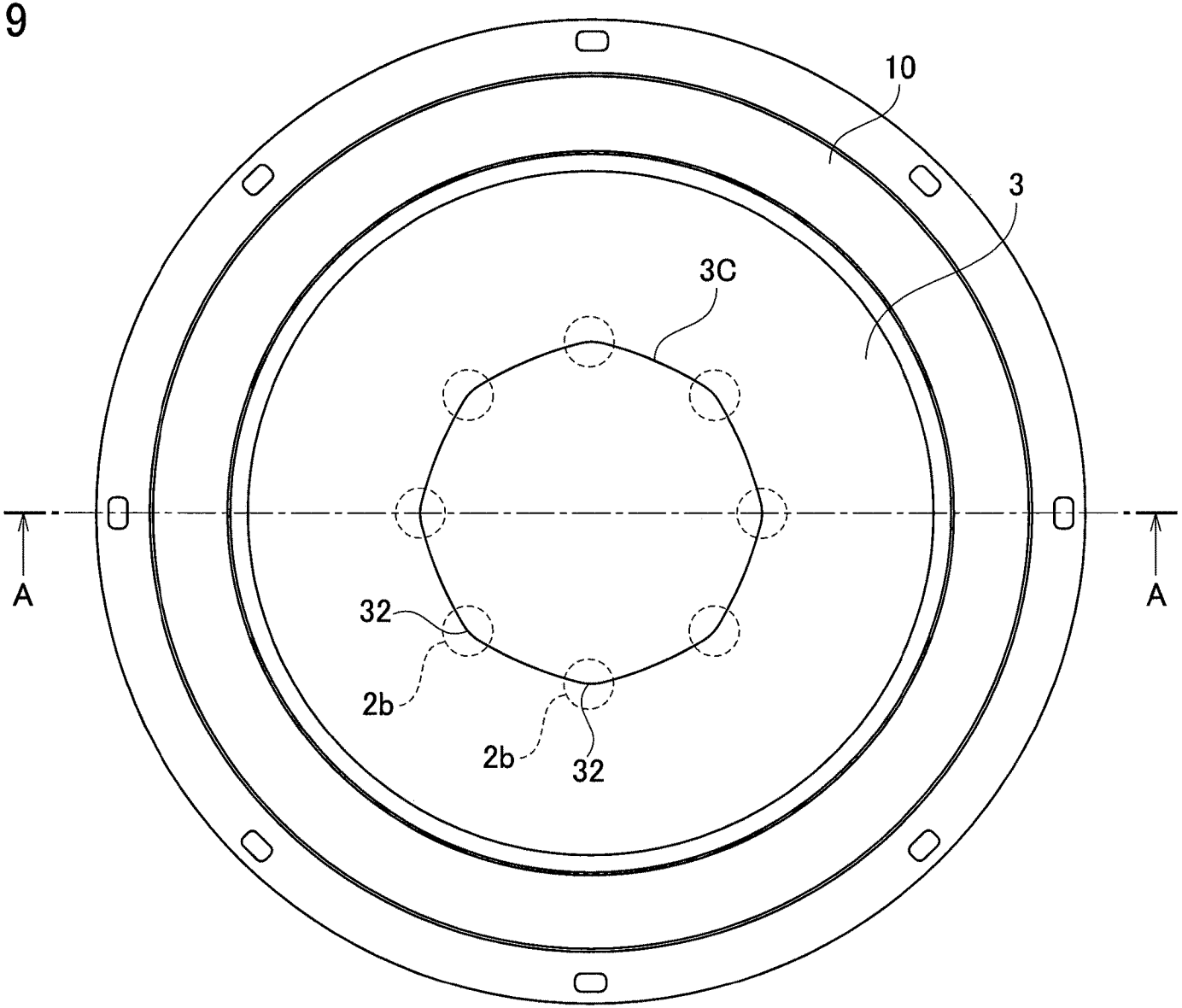
FIG. 9 is a plan view illustrating the diaphragm fixed with the cap viewed from the front side.
Figure 10:
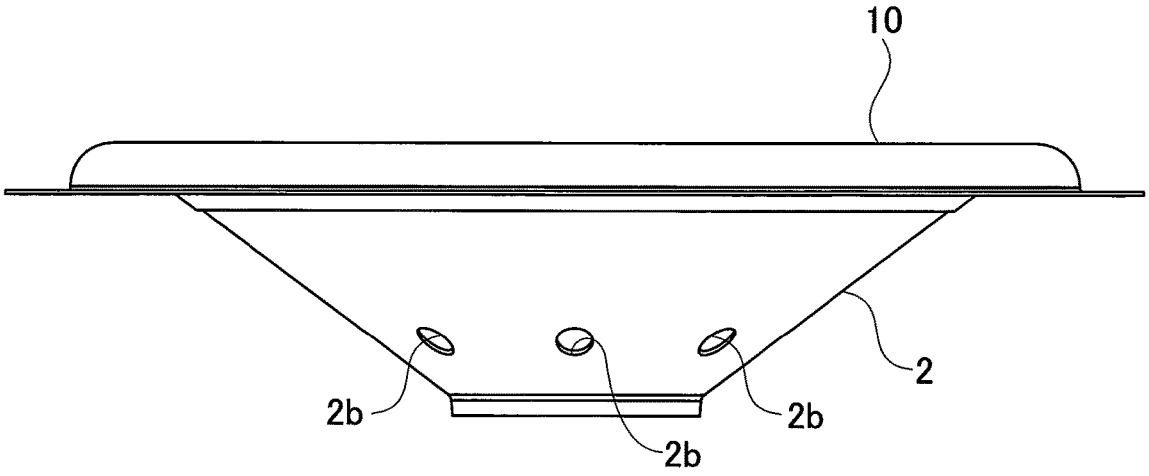
FIG. 10 is a side view illustrating the diaphragm to which the cap is fixed.
Figure 11:
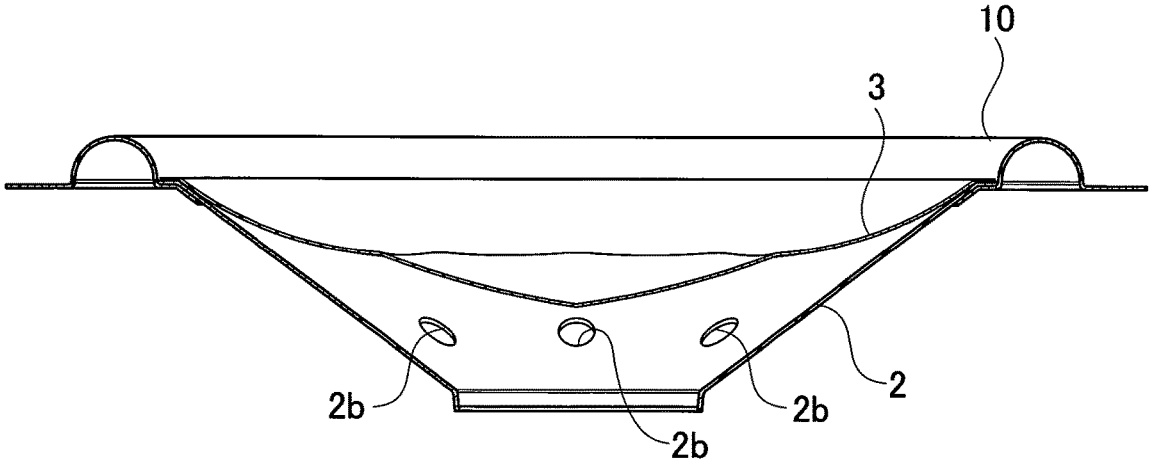
FIG. 11 is an A-A cross-sectional view of FIG. 9.

FIG. 8 is a perspective view of a state in which the cap 3 is fixed to the diaphragm 2 to which the edge 10 is fixed shown in FIG. 2, viewed from the front side, FIG. 9 is a plan view of the diaphragm 2 to which the cap 3 is fixed viewed from the front side, FIG. 10 is a side view of the diaphragm to which the cap 3 is fixed, and FIG. 11 is a cross-sectional view which is taken along a line A-A of FIG. 9. As shown in FIG. 9, the diaphragm 2 and the cap 3 are joined so that the eight holes 2*b* formed in the diaphragm 2 and the eight corners 32 of the boundary portion 3C of the cap 3 face one another.

As shown in FIG. 9, it is preferable that the rigidity-reinforcing portions such as the corners 32 face all of the holes 2*b*, but, the rigidity-reinforcing portions such as the corners 32 may face a part of the plurality of holes 2*b*.

Figure 12:
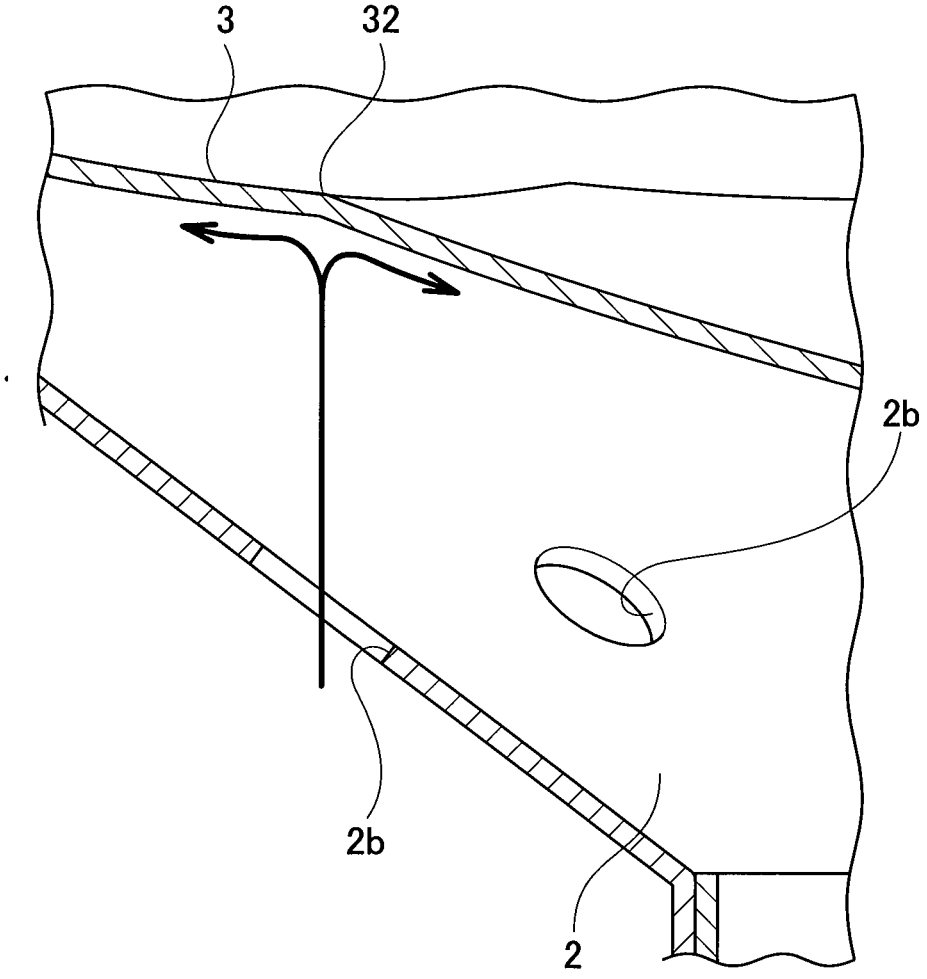
FIG. 12 is a partial cross-sectional view illustrating a state in which the air that has passed through the hole of the diaphragm flows after hitting the corner of the boundary portion formed on the cap.

When the diaphragm 2 is displaced to the side away from the yoke 7 by the vibration of the diaphragm 2, the air on the back side of the diaphragm 2 passes through the holes 2*b* and then flows into the space which is on the front side where the cap 3 is arranged and is between the diaphragm 2 and the cap 3. In FIG. 12, the air indicated by an arrow that flows toward the front side of the diaphragm 2 after passing through the hole 2*b* is blown to the corner 32. Since the rigidity is reinforced by the corner 32 having a bent shape, the distortion of the cap 3 is less likely to occur even when the air is blown, and the sound quality is less likely to deteriorate. Therefore, according to the speaker 100, the sound quality can be improved.

Moreover, since the corner 32 has a recessed shape in both the radial direction and the circumferential direction, the air blown on the corner portion 32 is easily flowed by being dispersed in the lower and upper directions in the radial direction, and is also easily dispersed in the circumferential direction. Accordingly, even when the air passing through the hole 2*b* hits the cap 3, a distortion is unlikely to occur, and therefore sound quality is less likely to deteriorate and the sound quality can be improved.

If the corner 32 has a protruded shape in both the radial direction and the circumferential direction, the air blown on the corner portion 32 is further easily flowed by being dispersed in the lower and upper directions in the radial direction and also in the circumferential direction.

Figure 13:
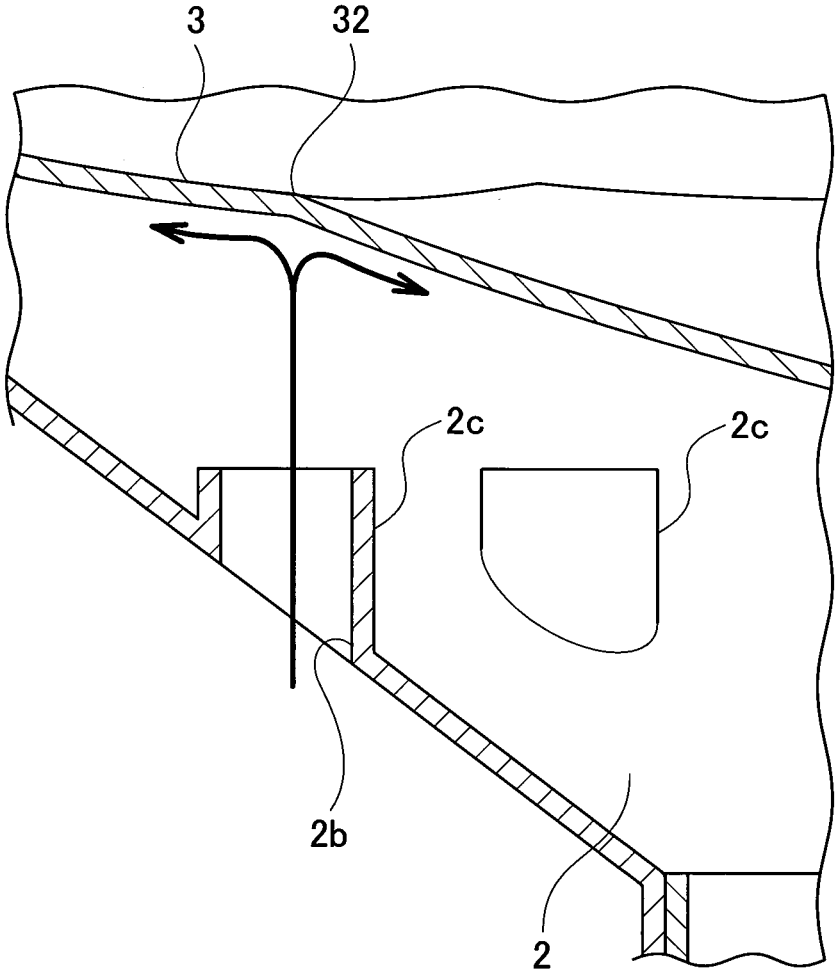
FIG. 13 is a partial cross-sectional view illustrating a modified example of the diaphragm.

FIG. 13 illustrates a modified example of the diaphragm 2. FIG. 13 is a partial cross-sectional view similar to that of FIG. 12. Around each of the holes 2*b* of the diaphragm 2, wall portions 2*c* projecting toward the corners 32 are formed. When the wall portion 2*c* is not provided, the separation phenomenon of the air passing through the hole 2*b* occurs at the edge of the hole 2*b* and the air flow is disturbed. The turbulence of the air flow becomes a resistance against the vibration of the diaphragm 2, causing the vibration of the diaphragm 2 to be disturbed. An irregular movement of the air causes abnormal noise.

The wall portion 2*c* formed around the hole 2*b* shown in FIG. 13 suppresses the local decrease in rigidity due to the formation of the hole 2*b* in the diaphragm 2, and further rectifies the flow of air passing through the hole 2*b*. Accordingly, the occurrence of abnormal noise due to the disturbed air flow when the diaphragm 2 vibrates can be suppressed, and the air flowing from the hole 2*b* can be smoothly guided to the boundary portion 3C.

Here, a state of the air flow near the edge of the hole 2*b* is considered. In FIG. 12, the air passing through the hole 2*b* is shown to go straight to the corner 32, but the air may flow in and out in the direction orthogonal to the surface of the diaphragm 2. By providing the wall portion 2*c*, the flow of air that is turbulently swirling at the edge of the hole 2*b* can be made to flow toward the corner 32, and the air inflow or outflow resistance can be reduced.

The wall portion 2*c* is particularly effective when the diaphragm 2 moves in the sound emitting direction. When the diaphragm 2 moves in the sound emitting direction, the air is sucked into the space between the diaphragm 2 and the cap 3, and the wall portion 2*c* suppresses the turbulence of the air on the front side of the diaphragm 2. The air is not disturbed when flowing into the hole 2*b* from the back side of the diaphragm 2, and alternatively turbulently swirls when flowing into the space between the diaphragm 2 and the cap 3 after flowing toward the front side of the diaphragm 2. By providing the wall portion 2*c*, the flow of air can be suppressed. The wall portion 2*c* may be projected to the back side of the diaphragm 2. When the wall portion 2*c* is projected to the back side of the diaphragm 2, the wall portion 2*c* can suppress the turbulence of the air flowing out from the space between the diaphragm 2 and the cap 3 to the back side of the diaphragm 2, as the diaphragm 2 moves in the direction opposite to the sound emitting direction.

The present invention is not limited by one or more embodiments described above and various modifications may be made without departing from the scope of the present invention. The speaker 100 is not limited to a subwoofer. The cap 3 may be provided with local conical recesses or protrusions corresponding to a plurality of holes 2*b*.

What is claimed is:

1. A speaker comprising:

a first diaphragm comprising one or more holes formed therein;

a second diaphragm arranged on a sound emitting side of the first diaphragm, the second diaphragm comprising a bent shape having sides and corners; and a driver comprising a magnetic circuit and a voice coil, and is configured to vibrate the first and second diaphragms, wherein the sides and corners function as a rigidity-reinforcing portion in which a rigidity of the second diaphragm is reinforced, with at least one of the sides or the corners facing at least one hole of the one or more holes.

2. The speaker according to claim 1, wherein a plurality of holes are formed in the first diaphragm at a predetermined radial position at predetermined intervals in the circumferential direction, and the rigidity-reinforcing portion is continuously formed over an entire circumference in the circumferential direction corresponding to the radial position where the plurality of holes are formed.

3. The speaker according to claim 1, wherein a wall portion is formed around each hole formed in the first diaphragm.

4. A speaker comprising:

a first diaphragm comprising one or more holes formed therein;

a second diaphragm arranged on a sound emitting side of the first diaphragm; and a driver comprising a magnetic circuit and a voice coil, and is configured to vibrate the first and second diaphragms, wherein the second diaphragm comprises a recess formed on a surface of the second diaphragm facing the first diaphragm, the recess functions as a rigidity-reinforcing portion in which a rigidity of the second diaphragm is reinforced, and the recess is facing at least one hole of the one or more holes.

5. The speaker according to claim 4, wherein the recess comprises a bent shape formed on the second diaphragm.

6. The speaker according to claim 4, wherein the second diaphragm comprises a recessed shape formed on the surface of the second diaphragm facing the first diaphragm in both a radial direction and a circumferential direction of the second diaphragm.

7. The speaker according to claim 4, wherein a wall portion is formed around each hole formed in the first diaphragm.

8. A speaker comprising:

a first diaphragm;

a second diaphragm arranged on a sound emitting side of the first diaphragm; and a driver comprising a magnetic circuit and a voice coil, and is configured to vibrate the first and second diaphragms, wherein n holes are formed in the first diaphragm at a predetermined radial position at equal intervals in a circumferential direction, where n is three or greater, a bent shape having an n-sided shape is formed in the second diaphragm as a rigidity-reinforcing portion in which a rigidity of the second diaphragm is reinforced, corresponding to the radial position where the n holes are formed, and each corner of the bent shape having the n-sided shape faces each hole of the n holes.

9. The speaker according to claim 8, wherein the corner comprises a recessed shape or a protruded shape in both a radial direction and a circumferential direction of the second diaphragm.

10. The speaker according to claim 8, wherein a wall portion is formed around each hole formed in the first diaphragm.

* * * * *